US006371481B1

(12) United States Patent
Miyake

(10) Patent No.: US 6,371,481 B1
(45) Date of Patent: Apr. 16, 2002

(54) MECHANISM FOR DISCHARGING A SHEET IN AN OUTPUT SIDE DIFFERENT FROM AN INLET SIDE WHILE REVERSING THE SAME

(75) Inventor: Hiromasa Miyake, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/440,470

(22) Filed: Nov. 15, 1999

(30) Foreign Application Priority Data

Nov. 18, 1998 (JP) ..... 10-343629

(51) Int. Cl.[7] ..... B65H 29/20
(52) U.S. Cl. ..... 271/314; 271/185; 271/186
(58) Field of Search ..... 271/185, 186, 271/314

(56) References Cited

U.S. PATENT DOCUMENTS 4,252,309 A * 2/1981 Garrison et al. ..... 271/186
4,858,909 A * 8/1989 Stemmle ..... 271/184
5,031,893 A * 7/1991 Yoneda et al. ..... 271/65
5,183,249 A * 2/1993 Ichikawa
5,201,517 A * 4/1993 Stemmle ..... 271/291
5,210,616 A * 5/1993 Kawasaki et al. ..... 358/296
5,215,298 A * 6/1993 Stemmle et al. ..... 271/65
5,263,703 A * 11/1993 Derrick ..... 271/186
5,449,163 A * 9/1995 Wong et al. ..... 271/186
6,070,869 A * 6/2000 Kim ..... 271/186

* cited by examiner

*Primary Examiner*—Christopher P. Ellis
*Assistant Examiner*—Richard Ridley

(57) ABSTRACT

A mechanism for reversing and discharging a sheet of the present invention includes a first roller for conveying the sheet and a second roller for nipping the sheet with the first roller. After an image has been printed on the sheet, a drive mechanism causes the first and second rollers to convey the sheet until the trailing edge of the sheet arrives at a position of the inlet side spaced from the first roller by a preselected distance. Subsequently, the drive mechanism rotates the first roller in the reverse direction and moves the second roller along the circumference of the first roller by a preselected angle in the reverse direction, thereby conveying the sheet to an outlet section. The mechanism is capable of discharging the sheet in a side opposite to a side in which the sheet is input, while surely reversing the sheet. The mechanism therefore allows a print head to be arranged in the lower portion of an apparatus to which the mechanism is applied.

10 Claims, 11 Drawing Sheets

MECHANISM FOR DISCHARGING A SHEET IN AN OUTPUT SIDE DIFFERENT FROM AN INLET SIDE WHILE REVERSING THE SAME

BACKGROUND OF THE INVENTION

The present invention relates to a mechanism for discharging a sheet and more particularly to a mechanism applicable to, e.g., a printer for discharging a sheet after reversing it.

To better understand the present invention, brief reference will be made to a conventional printer shown in FIG. 10. As shown, the conventional printer includes paper or similar recording medium implemented as a roll 101. A print head 102 prints an image on the paper paid out from the roll 101. A cutter 103 cuts off the printed part of the paper. The cut paper or sheet is directly driven out of the printer. The print head 102 is affixed to a retraction mechanism 106movable up and down. Moreover, the print head 102 and retraction mechanism 106 are fixed to an upper unit 104, which is movable around a turn axis X toward and away from a lower unit 105.

The problem with the retraction mechanism 106 including the print head 102 is that it is heavy and has a number of signal cables and power feed cables connected thereto. Therefore, when considering its weight and cable wiring, it is unsuitable to mount the retraction mechanism 106 on the upper unit 104.

In light of the above, the print head 102 maybe mounted on the lower unit 105 underlying the roll 101. This, however, brings about another problem. That is, the sheet is driven out of the printer face down, i.e., with its printed surface facing downward. Therefore, its print condition cannot be easily confirmed.

To discharge a sheet face up, a mechanism for reversing the sheet before discharging it has been proposed in various forms in the past. Referring to FIG. 11, it shows a specific conventional sheet reversing mechanism. As shown, the conventional mechanism includes a picker roller 110 and a belt 111 for nipping sheets 109 stacked on the belt 111 face down. A drive section, not shown, drives the picker roller 110, the belt 111 and a belt 112 contacting the downstream side of the belt 111 at the same speed in a direction indicated by an arrow. As a result, the sheet 109 is fed to a nip between the belts 111 and 112 while being pressed by the picker roller 110 against the guide 115. The belts 111 and 112 reverse the sheet 109 little by little along the contour of a guide member 113 while conveying it to a guide 114. Consequently, the sheet 109 is positioned on the guide 114 face up.

However, in the configuration shown in FIG. 11, the sheet 109 is conveyed in one direction, turned down, and then conveyed in the other direction different from the above direction. When this configuration is applied to the layout shown in FIG. 10, the paper 109 cannot be discharged in an opposite side to the input side in which it is input. That is, the paper 109 must be output in the same side in which it is input.

SUMMARY OF THE INVENTION

It is therefore an object of the present invention to provide a mechanism capable of reversing a sheet on a sheet conveyance path and then discharging it, and capable of outputting the sheet in a side opposite to an input side by conveying it in substantially the same direction. A mechanism for reversing and discharging a sheet of the present invention includes a first roller for conveying the sheet and a second roller for nipping the sheet with the first roller. After an image has been printed on the sheet, a drive mechanism causes the first and second rollers to convey the sheet until the trailing edge of the sheet arrives at a position spaced from the first roller by a preselected distance. Subsequently, the drive mechanism rotates the first roller in the reverse direction and moves the second roller along the circumference of the first roller by a preselected angle in the reverse direction, thereby conveying the sheet to an outlet section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

An embodiment of a mechanism for discharging a sheet of the present invention will be described with reference to the accompanying drawings in detail below.

Figure 1:
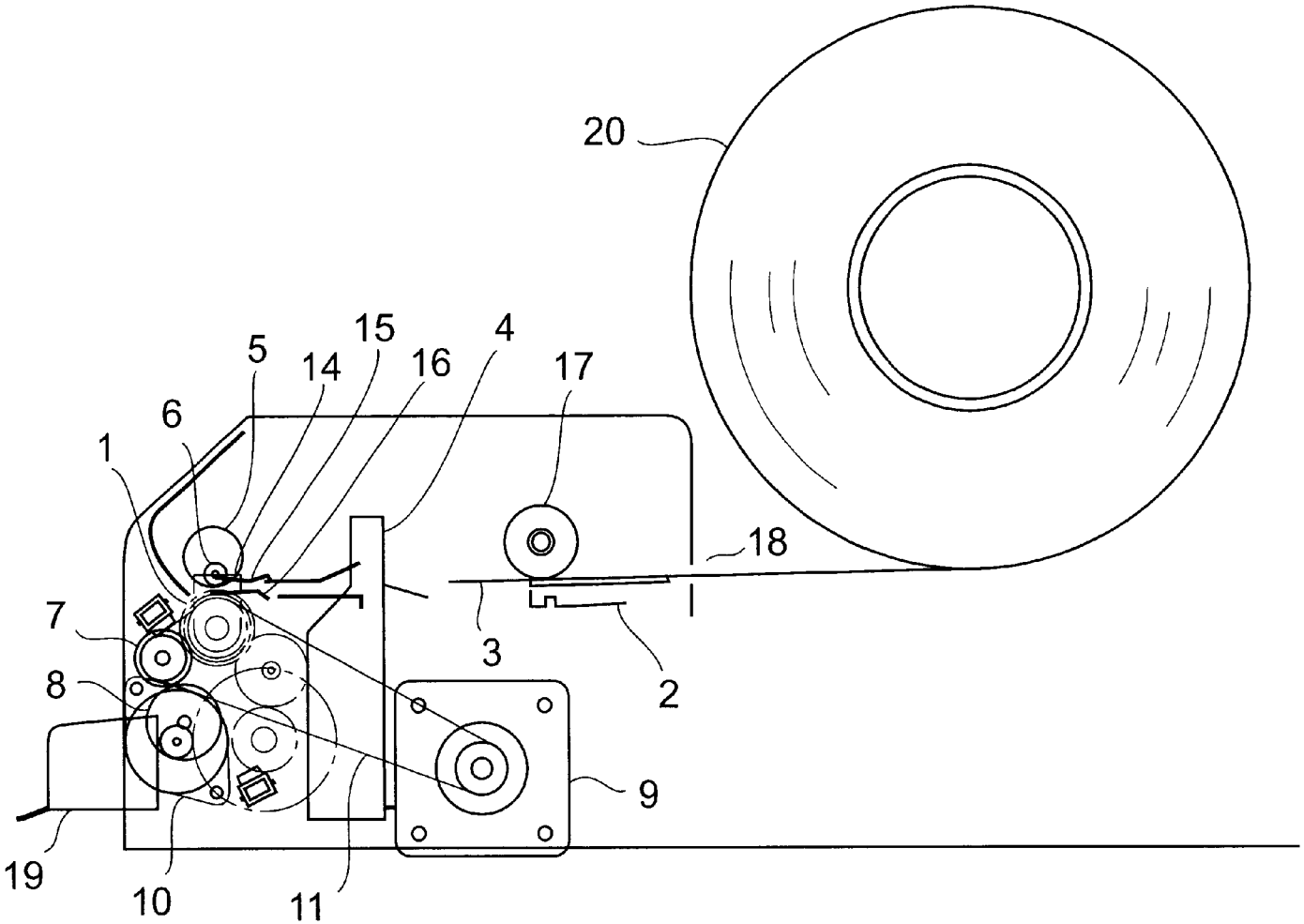
FIG. 1 is a sectional view showing an embodiment of the present invention.

Referring to FIG. 1 of the drawings, a sheet reversing and discharging mechanism embodying the present invention is shown and applied to a printer byway of example. As shown, the printer includes paper 3 or similar recording medium implemented as continuous webbing, i.e., a roll 20. At an inlet section, a print head 2 prints an image on the paper 3 paid out via an inlet port 18 from the roll 20. A platen roller 17 conveys the paper 3 while pressing it against the print head 2. A cutter 4 cuts the paper 3 paid out via the print head 2 at a preselected length. A drum roller 1 and a pusher roller 5 cooperate to convey the cut paper (sheet hereinafter) 3. A reverse roller 6 guides the sheet 3 such that the sheet 3 wraps around the drum roller 1. An outlet roller 7 and an outlet pusher roller 8 drive the sheet 3 out of the printer. A drum roller motor 9, as first drive source, drives first drive system including the drum roller 1 and outlet roller 7. A reverse motor 10, as second drive source, drives second drive system including the reverse roller 6 and a reverse gear block 14. In the illustrative embodiment, the drum roller 1, reverse roller 6 and motors 9 and 10 constitute a sheet reversing section in combination.

Figure 2:
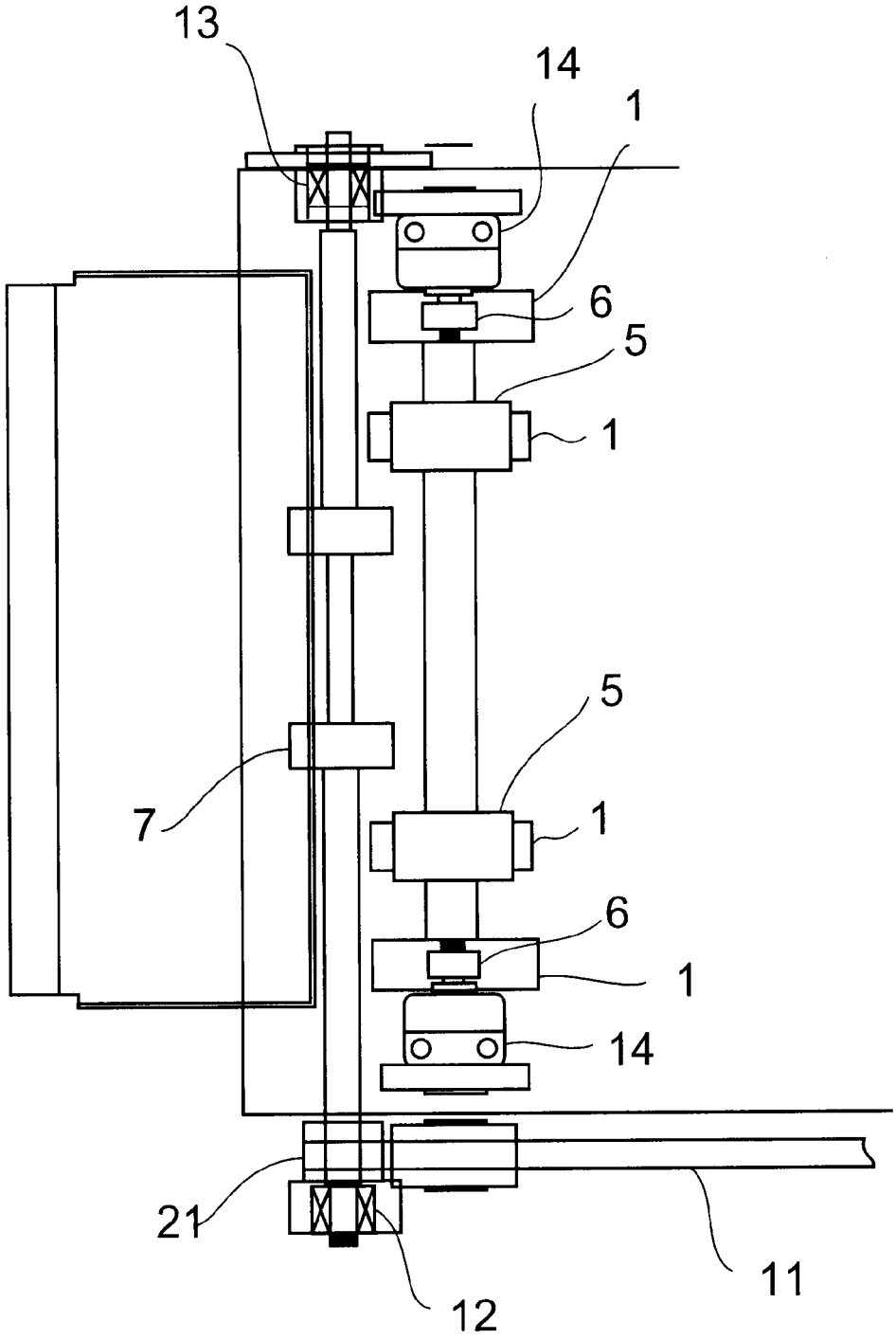
FIG. 2 is a fragmentary plan view showing the embodiment of the present invention.

FIG. 2 shows the above sheet reversing section more specifically. Referring to FIG. 2, the drum roller 1 is implemented by four drum rollers 1. Likewise, the reverse roller 6 and pusher roller 5 are implemented by two turn rollers 6 and two pusher rollers 5, respectively. The reverse rollers 6 are respectively held in contact with the circumferences of axially outermost two of the four drum rollers 1. The reverse rollers 6 each are movable over a predetermined angle range on the circumference of the associated drum roller 1. The pusher rollers 5 are respectively pressed against the upper portions of the other two drum rollers 1 arranged between the outermost drum rollers 1.

The first drive system assigned to the drum roller motor 9 will be described more specifically. The rotation of the drum roller motor 9 is transferred to the drum rollers 1 and outlet rollers 7 by a belt 11. In the illustrative embodiment, one-way clutches 12 and 13 are mounted on a shaft supporting the outlet rollers 7. The one-way clutch 12 is fixedly arranged in an outlet roller pulley 21 over which the belt 11 is passed. The other one-way clutch 13 is mounted on the shaft of the outlet rollers 7 and prevents the outlet rollers 7 from rotating in a direction opposite to a direction in which the sheet 3 should be driven out (direction of sheet discharge hereinafter) to an outlet port 19. That is, power is transmitted to the outlet rollers 7 in one direction, i.e., only in the direction of sheet discharge to the outlet port 19. The outlet rollers 7 are therefore rotatable in the direction of sheet discharge, but not rotatable in the opposite direction. The outlet port 19 is arranged at a side different from a side the inlet port 18 arranged.

As for the second drive system assigned to the reverse motor 10, the reverse rollers 6 are rotatably arranged to a reverse gear block 14. The reverse gear blocks 14 are freely rotatable about an axis of rotation of the drum rollers 1. The rotation of the reverse motor 10 is transferred to the reverse gear blocks 14 so as to freely control the reverse gear blocks 14 to any rotation angle. When the reverse gear blocks 14 rotate about the above axis, the reverse rollers 6 roll on the circumferences of the associated drum rollers 1 in contact with the rollers 1. As shown in FIG. 1, an upper paper guide 15 and a lower paper guide 16 are affixed to each reverse gear block 14 in a pair and angularly movable together with the reverse gear blocks 14.

Figure 3:
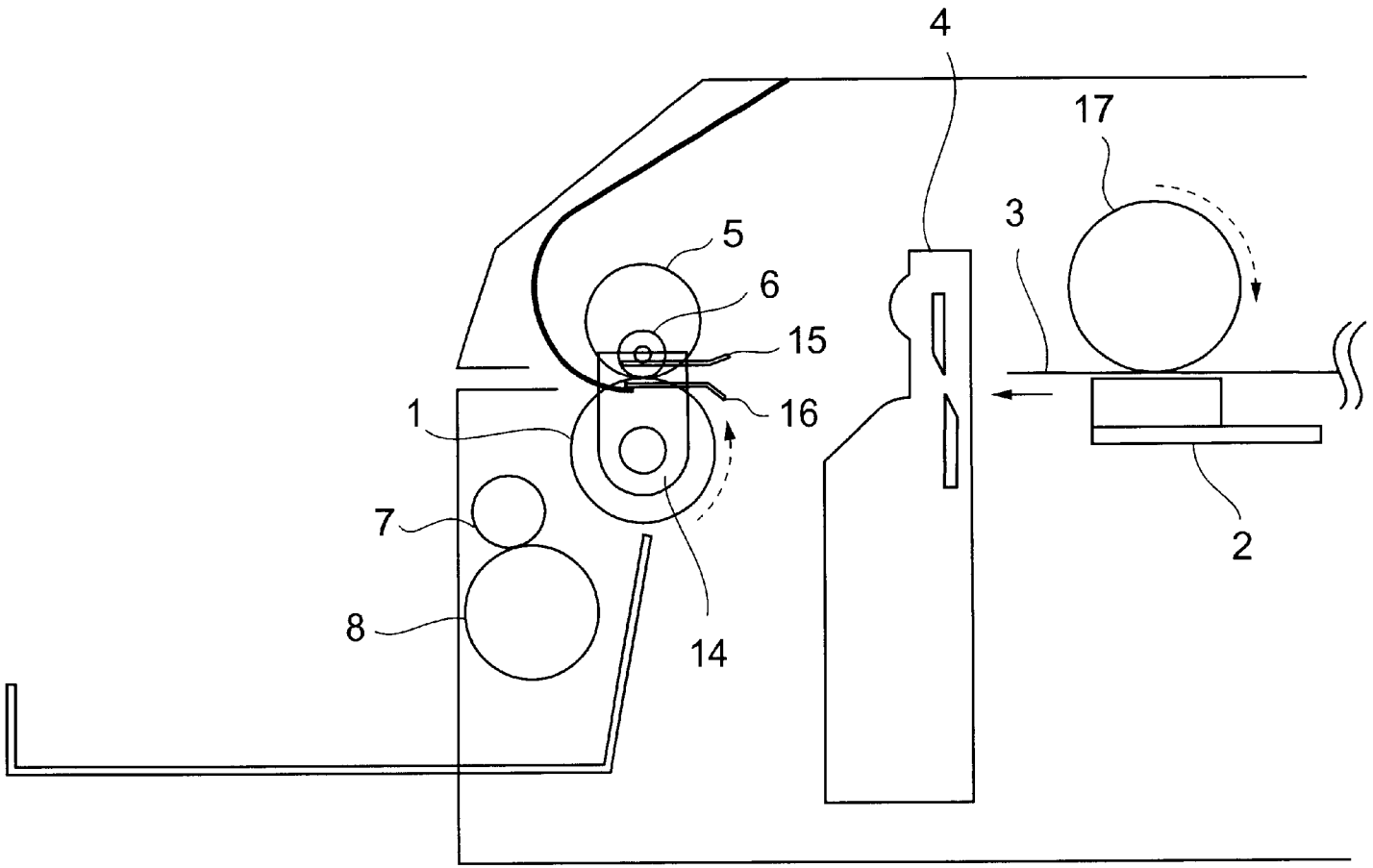
FIG. 3 is first sectional view explaining the embodiment of the present invention.

The operation of the illustrative embodiment will be described with reference to FIGS. 1 and 3–8. As shown in FIG. 1 and 3, the print head 2 prints an image on the lower surface of the paper 3 being conveyed by the platen roller 17 at the inlet section. The leading edge of the paper 3 is fed to the drum rollers 1 via the cutter 4. At this instant, the drum roller motor 9 drives the drum rollers 1 such that the rollers 1 convey the paper 3 in the direction of sheet discharge, i.e., leftward as viewed in FIG. 3. The reverse gear blocks 14 are held in a halt on the upper portions of the associated drum rollers 1.

Figure 4:
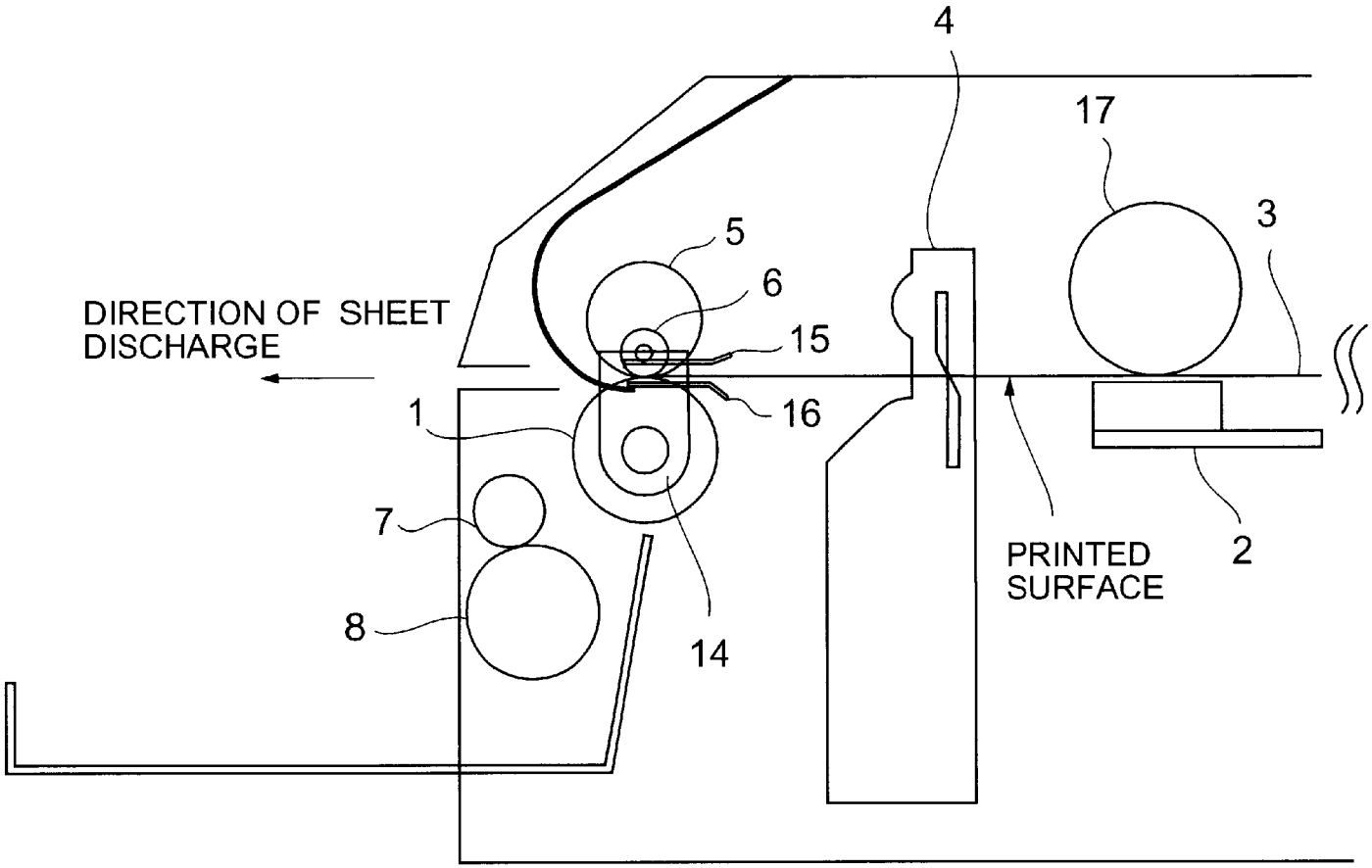
FIG. 4 is second sectional view explaining the embodiment of the present invention.

The leading edge of the paper 3 moves via nips between the drum rollers 1 and the pusher rollers 5 or reverse rollers 6. When the paper 3 is conveyed by a predetermined distance after printing, the drum roller motor 9 stops the rotation of the drum rollers 1 and therefore interrupts the conveyance of the paper 3. In this condition, the cutter 4, cutting off the printed part of the paper 3, thereby produce a cut sheet 3*a*, as shown in FIG. 4.

The drum roller motor 9 disclosed in FIG. 1 again drives the drum rollers 1 in order to further convey the sheet 3*a* leftward, i.e., in the direction of sheet discharge. Specifically, as shown in FIG. 5, the drum roller motor 9 drives the drum rollers 1 until the trailing edge of the sheet 3*a* arrives at a position of inlet side with distance d from a contact point of the drum rollers 1 and reverse rollers 6.

The distance, from the cutting plane of the cutter 4 to the above position spaced from the contact point by the distance d, is preselected in accordance with the configuration of an apparatus to which the mechanism is applied. The drum roller motor 9 therefore should only rotate the drum rollers 1 by a preselected amount. Alternatively, the drum roller motor 9 may interrupt the rotation of the drum rollers 1 in response to the output of a sensor responsive to the arrival of the trailing edge of the sheet 3*a* at the above position. It is to be noted that the distance d allows the drum rollers 1 and reverse rollers 6 to surely nip the trailing edge of the sheet 3*a* and may be suitably selected in accordance with the configuration of an apparatus.

Figure 5:
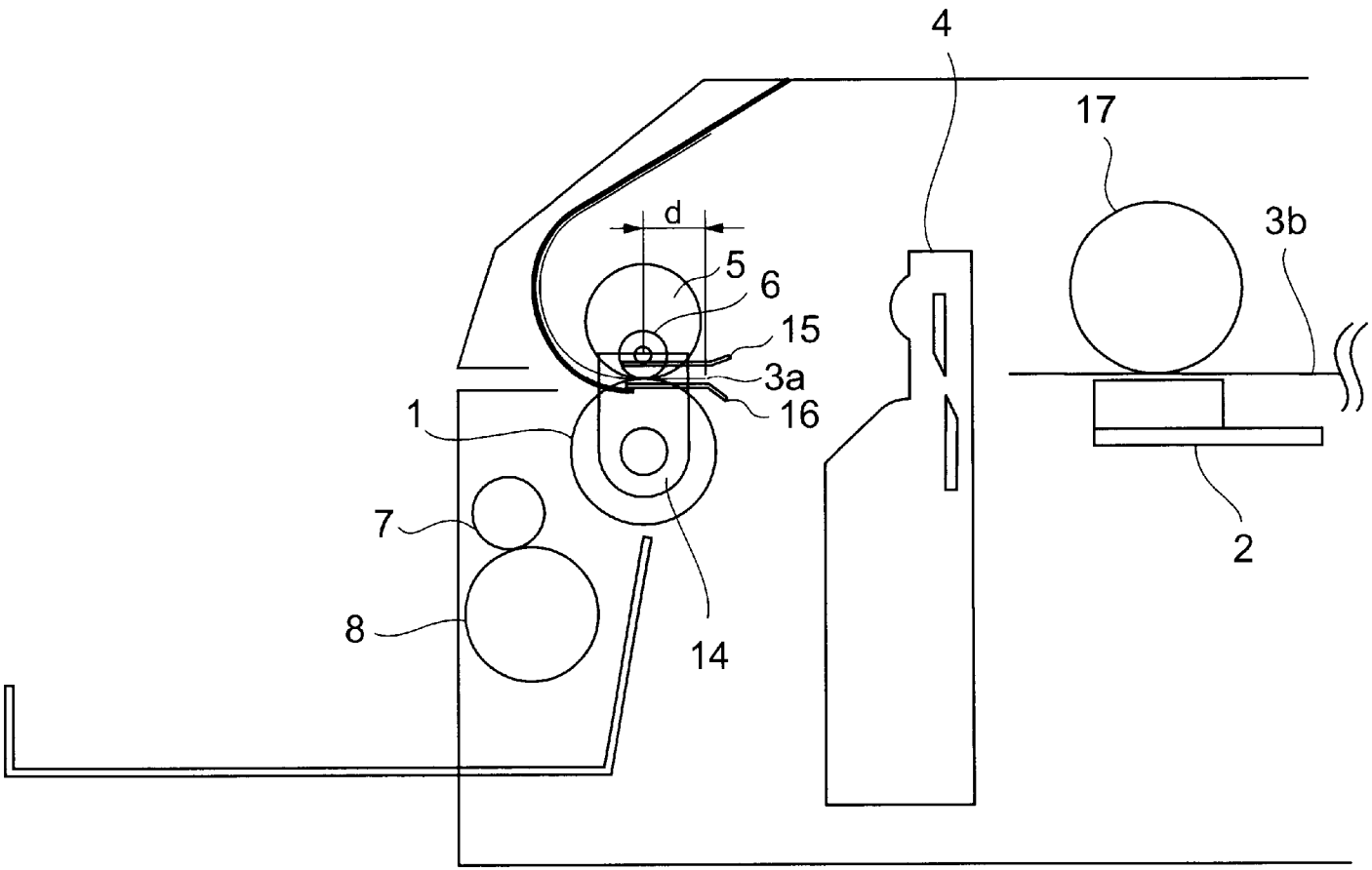
FIG. 5 is third sectional view explaining the embodiment of the present invention.

As shown in FIG. 5, the paper, labeled 3*b*, from which the sheet 3*a* has been cut off is pulled back to a position where it waits for the next printing operation.

In the condition shown in FIG. 5, the drum roller motor 9 disclosed in FIG. 1 is caused to rotate in the reverse direction and, in turn, rotates the drum rollers 1 in the reverse direction, i.e., clockwise. At the same time, the reverse motor 10 rotates the reverse gear blocks 14 such that the reverse rollers 6 move clockwise along the circumferences of the drum rollers 1 at the same angular velocity as the drum rollers 1. At this time, the pusher rollers 5 are pressing the sheet 3*a* against the associated drum rollers 1.

Figure 6:
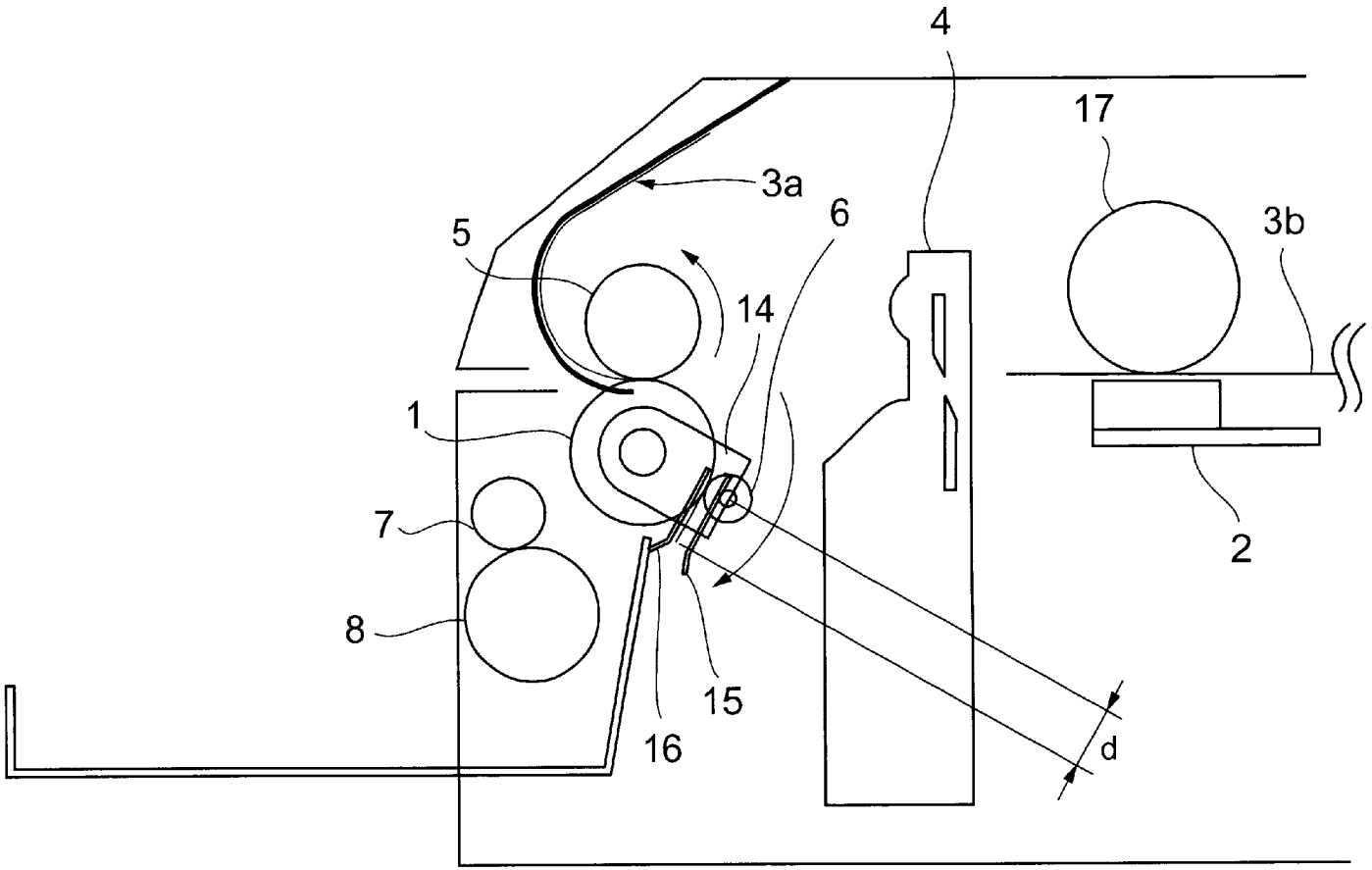
FIG. 6 is forth sectional view explaining the embodiment of the present invention.

As a result, as shown in FIG. 6, the trailing edge of the sheet 3*a* (the leading edge in the direction of current movement) is conveyed without varying the distance d measured tangentially form the contact point between the drum rollers 1 and the reverse rollers 6. The sheet 3*a* is therefore sequentially wrapped around the drum rollers 1.

Figure 7:
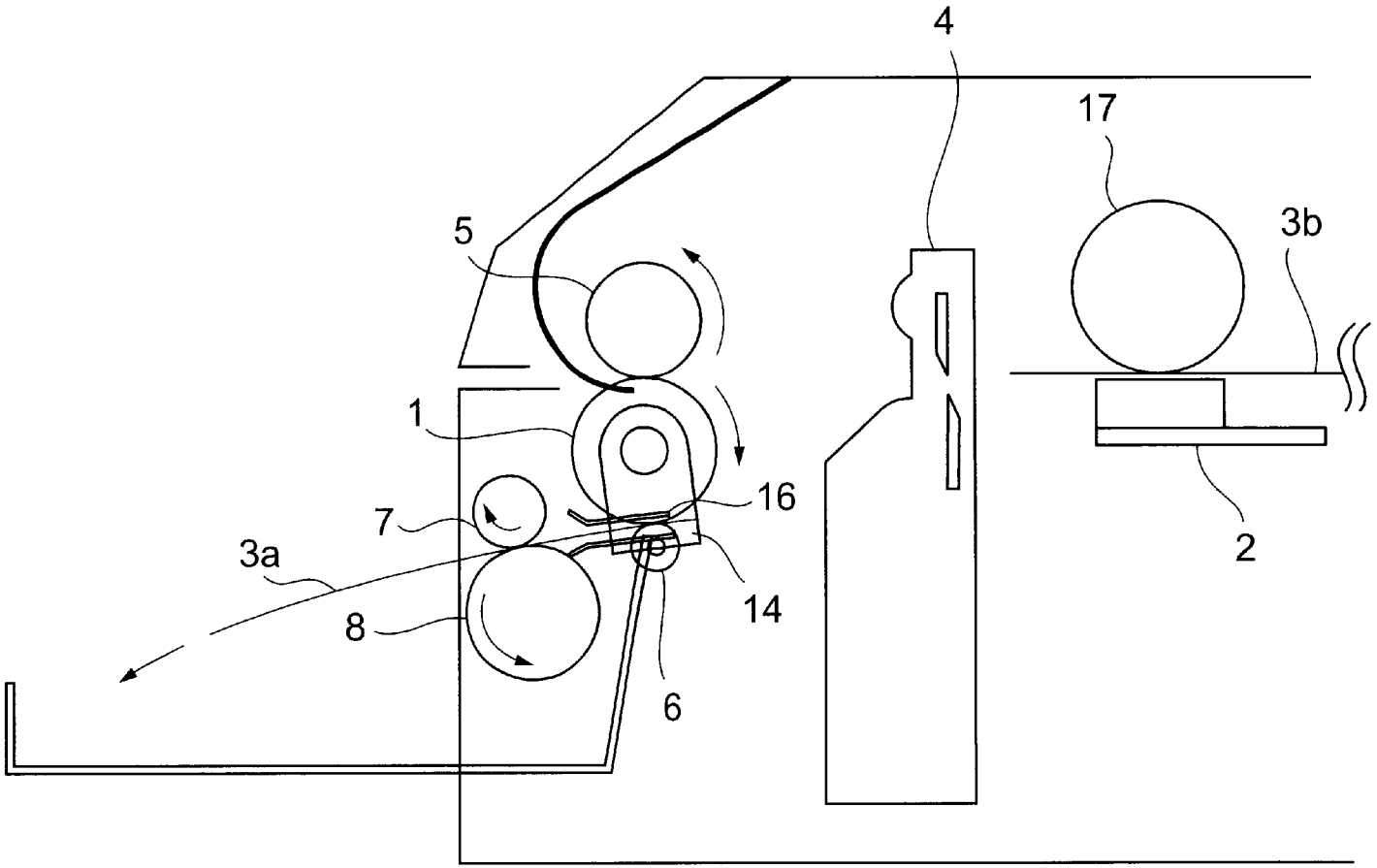
FIG. 7 is fifth sectional view explaining the embodiment of the present invention.
Figure 8:
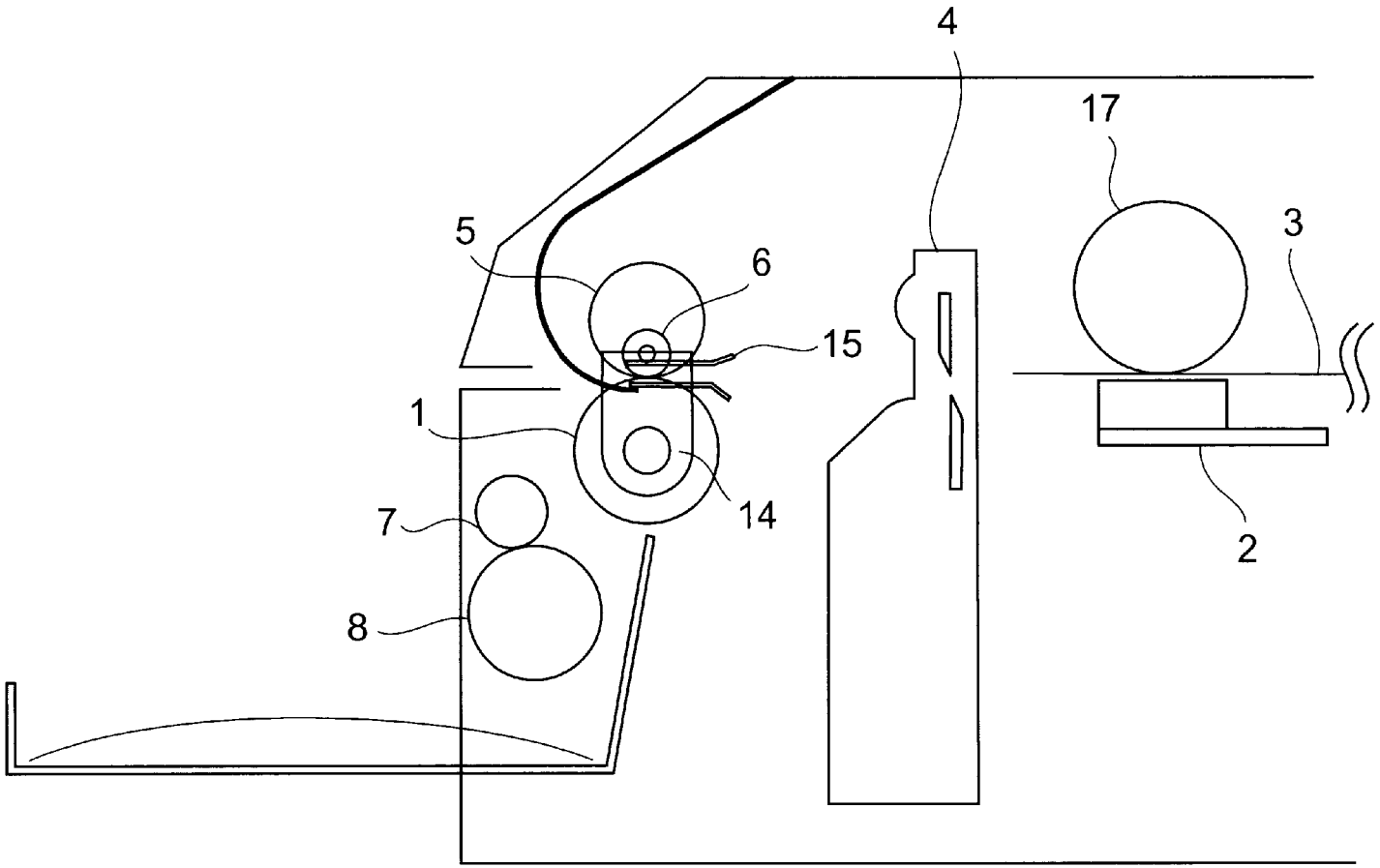
FIG. 8 is sixth sectional view explaining the embodiment of the present invention.

As shown in FIG. 7, when the reverse rollers 6 are brought to an outlet section, i.e., a position close to the outlet pusher roller 8, the reverse roller motor 10 stops rotating the reverse gear blocks 14. On the other hand, the drum roller motor 9 continuously rotates the drum rollers 1. Consequently, the sheet 3*a* begins to be conveyed tangentially away from the contact point between the drum rollers 1 and the reverse rollers 6. The leading edge of the sheet 3*a* (the trailing edge in the direction of current movement) is brought to a nip between the outlet roller 7 and the outlet pusher roller 8 at the outlet section, and then driven out of the printer via the outlet port 19 by the rollers 7 and 8. The sheet 3*a* is reversed upside down when transferred from the drum rollers 1 and reverse rollers 6 to the outlet roller 7 and outlet pusher roller 8. The sheet 3*a* is therefore driven out of the printer face up, i.e., with its printed surface facing upward, as shown in FIG. 8.

The one-way clutch 12 is built in the outlet roller pulley 21 which rotates the outlet roller 7, as described with reference to FIG. 2. Therefore, while the drum roller motor 9 reversibly rotates for rotating the drum rollers 1 and outlet roller 7, the outlet roller 7 rotates only when driven in the direction in which the sheet 3*a* should be discharged from the printer. This successfully prevents the sheet 3*a* from being conveyed in the reverse direction.

As stated above, in the illustrative embodiment, various rollers for turning down and discharging the sheet 3*a*, i.e., the drum rollers 1, pusher rollers 5, reverse rollers 6, outlet roller 7 and outlet pusher roller 8 can be positioned close to each other, implementing a compact reversing and discharging mechanism.

Further, the sheet 3*a* cut off from the roll 20 by the cutter 4 is driven out of the printer from its trailing edge while being wrapped around the drum rollers 1. The sheet 3*a* can therefore be reversed and discharged without regard to its length. However, the prerequisite is that the sheet 3*a* has a length greater than the distance between the cutter 4 and the drum rollers 1.

In addition, because the sheet 3*a* is driven out of the printer face up, the sophisticated printing mechanism including the print head 2 can be arranged in the lower portion of the printer so as to lower the center of gravity of the printer.

It should be noted that the configurations, numbers and dimensions of the various structural elements shown and described are only illustrative and may be changed to meet design requirements.

Figure 9:
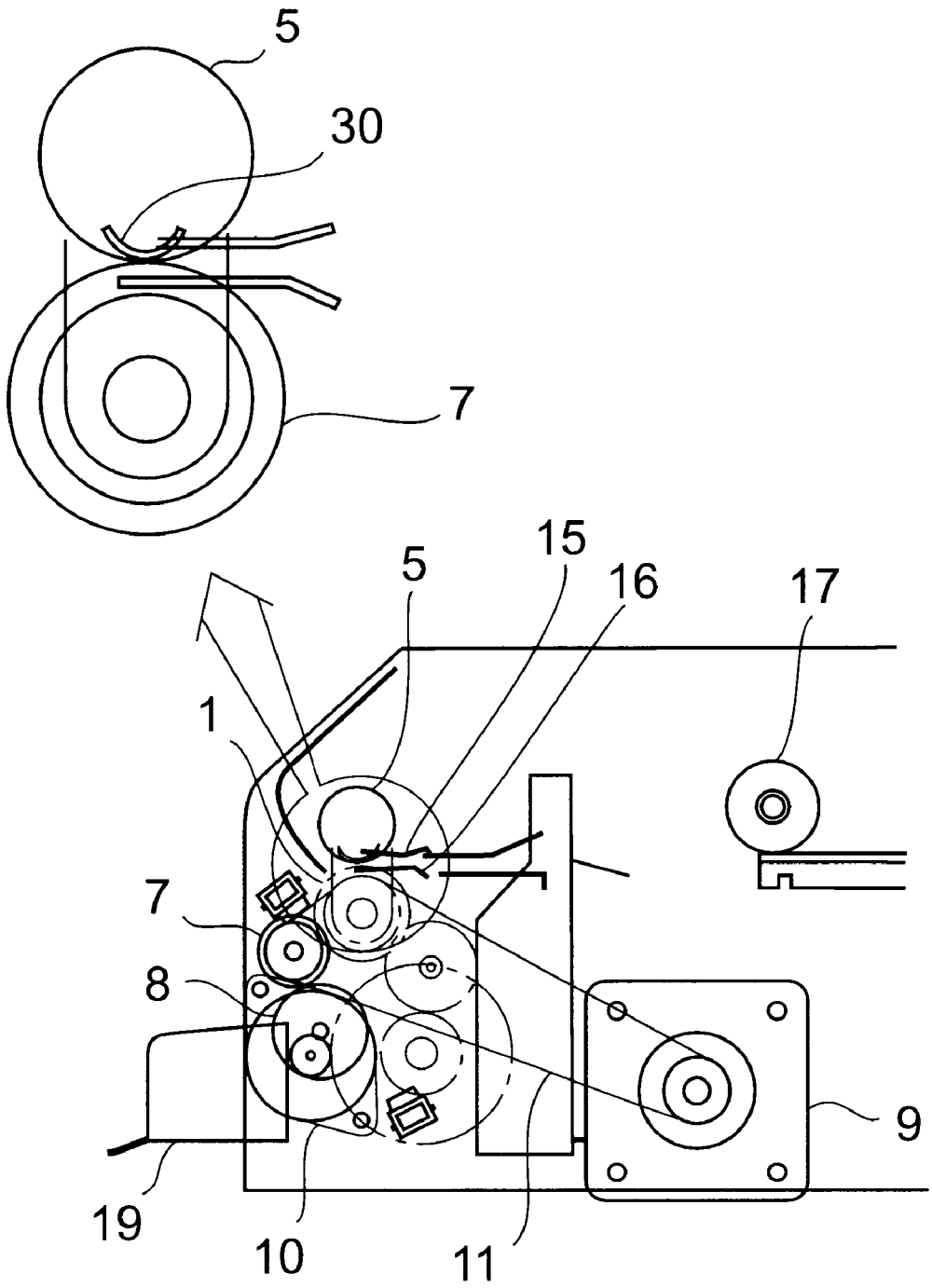
FIG. 9 is a sectional view showing an alternative embodiment of the present invention.
Figure 10:
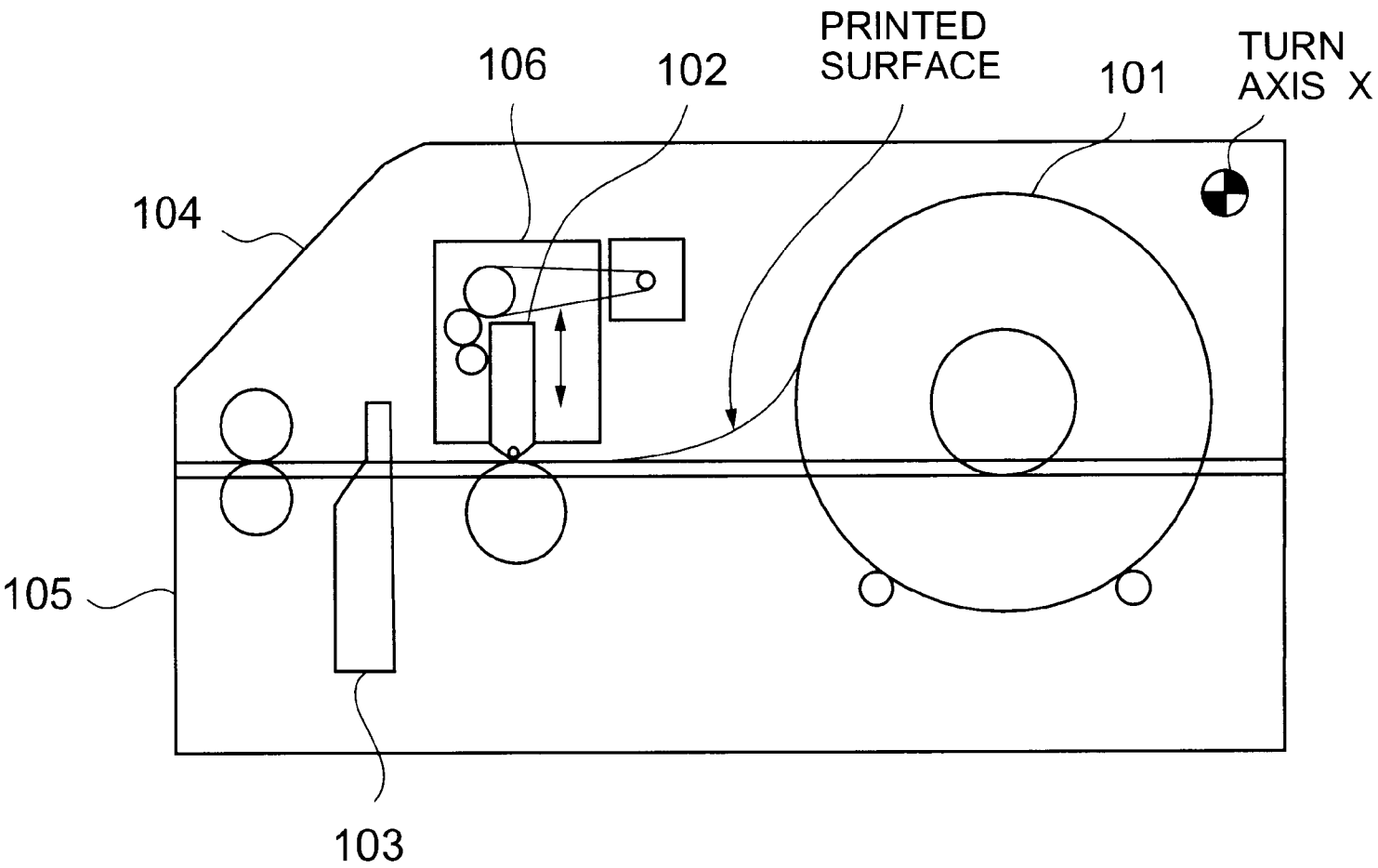
FIG. 10 is a view showing a conventional printer.
Figure 11:
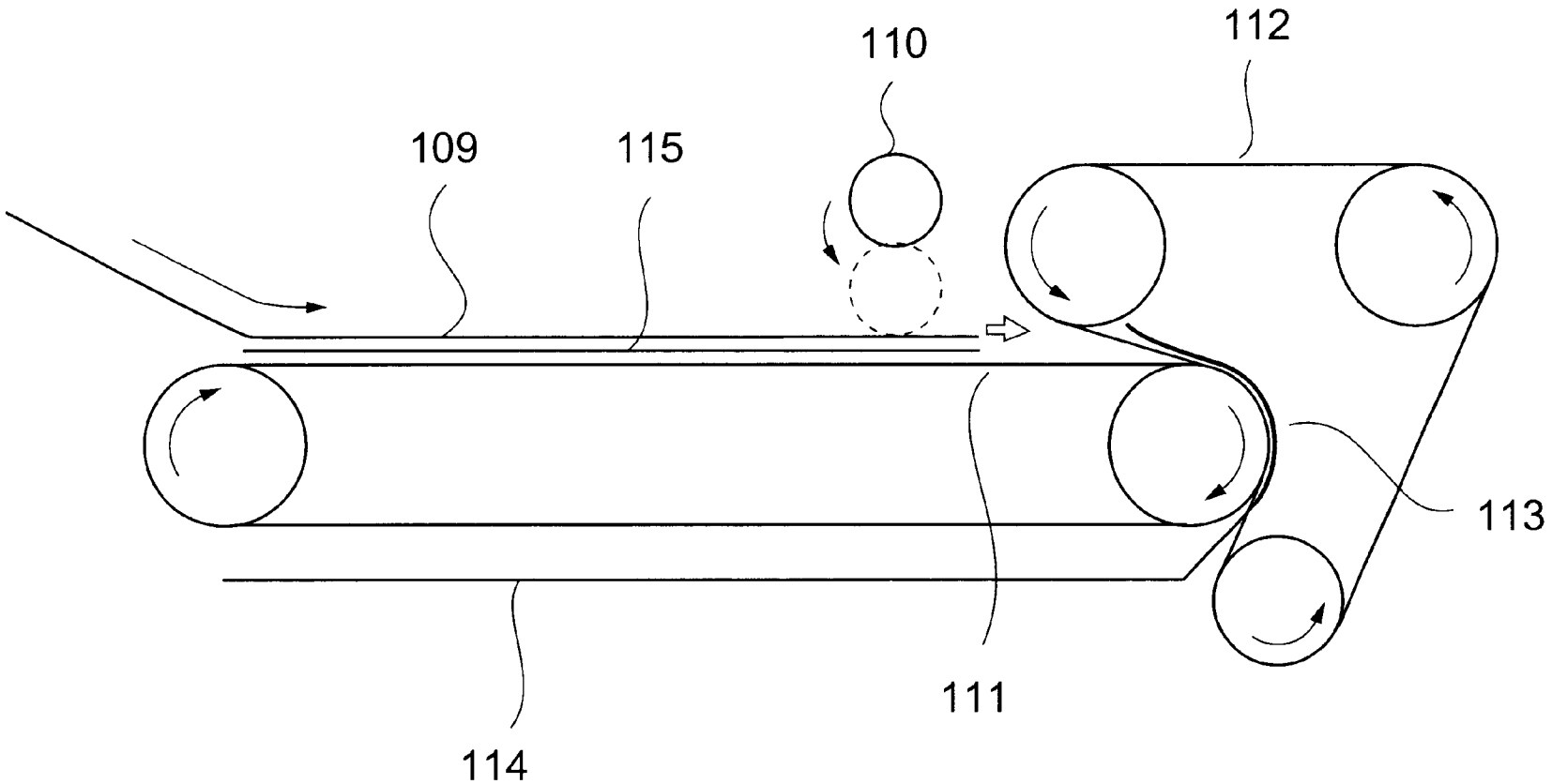
FIG. 11 is a view showing a conventional sheet reversing mechanism.

FIG. 9 shows an arcuate plate 30 which may be substituted for the cylindrical reverse rollers 6. The arcuate plate 30 is not rotatable and only lightly presses the sheet 3*a*. In this alternative configuration, the reverse motor 10 rotates the reverse gear blocks 14 such that the plate 30 moves along the circumference of the drum rollers 1 in accordance with the angular velocity of the drum rollers 1 while pressing the sheet 3*a*. The pusher rollers 5 press the sheet 3*a* against the drum rollers 1, as in the illustrative embodiment.

In the above condition, the trailing edge of the sheet 3*a* (the leading edge in the direction of current movement) is also conveyed without varying the distance d measured tangentially from the contact point between the drum rollers 1 and the reverse rollers 6. The sheet 3*a* is therefore sequentially wrapped around the drum rollers 1.

In summary, it will be seen that the present invention provides a sheet reversing and discharging mechanism capable of surely reversing a sheet and discharging it at a downstream position in the direction of sheet conveyance. The sheet can therefore be driven out in a side opposite to a side in which it is input. A group of rollers are used to reverse the sheet and can be arranged close to each other, making the mechanism compact.

Further, after the sheet has been cut off from paper or roll by a cutter, it is driven out from its leading edge while being wrapped around drum rollers. The sheet can therefore be reversed and then discharged without regard to its length. In addition, because the sheet is driven out of the printer face up, a print head can be positioned in the lower portion of an apparatus to which the mechanism is applied, thereby lowering the center of gravity of the apparatus.

What is claimed is:

1. A mechanism for reversing and discharging a sheet, comprising:

an inlet section which includes a means for conveying the sheet in a first sheet conveyance direction;

an outlet section, located at an end of a sheet conveyance path, said outlet section including a means for discharging the sheet to an outlet port in a second sheet conveyance direction, said second sheet conveyance direction and said first sheet conveyance direction being substantially the same direction; and a reversing section located between said inlet section and said outlet section, wherein said reversing section includes:

a first roller for conveying the sheet;

a second roller for nipping the sheet with said first roller;

a first drive source for driving said first roller in a forward direction to convey a printed sheet in said first sheet conveyance direction until a trailing edge portion of said sheet arrives at a predetermined position from said first roller, and then driving said first roller in a reverse direction opposite to said forward direction; and a second drive source for driving said second roller to move back and forth on the circumference of said first roller over a predetermined angular range, said second drive source driving, when said first roller is rotated in said reverse direction, said second roller to move over the predetermined angular range in said reverse direction of said first roller at a same angular velocity as said first roller.

2. The mechanism as claimed in claim 1, wherein said first drive source continuously drives said first roller to rotate in said reverse direction even after said second roller has been stopped at an end of the predetermined angular range, thereby feeding the sheet to said outlet section.

3. The mechanism as claimed in claim 1, said outlet section comprising a third roller for discharging the sheet, said first drive source driving said third roller in synchronism with said first roller.

4. The mechanism as claimed in claim 3, said outlet section further comprising a one-way clutch intervening between said third roller and said first drive source for transferring to said third roller only a drive force acting in a direction in which the sheet is discharged to said outlet port.

5. The mechanism as claimed in claim 3, said reversing section further comprising a guide for guiding the sheet toward said first roller;

wherein said second drive source causes said guide, when said first roller is rotated in said reverse direction, to move on the circumference of said first roller together with said second roller over a predetermined angle and then to guide the sheet toward said outlet section.

6. A mechanism for reversing and discharging a sheet, comprising:

a first roller for conveying the sheet;

a second roller for nipping the sheet with said first roller; and a first drive source for driving said first roller to selectively rotate in said forward direction and said reverse direction, said first drive source driving said first roller in a forward direction to convey the sheet until a trailing edge portion of said sheet arrives at a predetermined distance from said first roller, and then driving said first roller in a reverse direction opposite to said forward direction; and a second drive source for driving said second roller to move back and forth on the circumference of said first roller over a predetermined angular range, wherein said second drive source drives, when said first roller is rotated in said reverse direction, said second roller to move over the predetermined angular range in said reverse direction of said first roller at a same angular velocity as said first roller.

7. The mechanism as claimed in claim 6, further comprising:

a guide for guiding the sheet into a reversing section, said second drive source causing, when said first roller is rotated in said reverse direction, said guide to move on the circumference of said first roller together with said second roller over a pre-selected angle and then guide the sheet toward an outlet port.

8. The mechanism as claimed in claim 7, said outlet section comprising a third roller for discharging the sheet, said first drive source driving said third roller in synchronism with said first roller.

9. The mechanism as claimed in claim 7, wherein said outlet port is arranged at a side different from a side where an inlet portion arranged.

10. A mechanism for reversing and discharging a sheet, comprising:

a first roller for conveying the sheet;

a second roller for nipping the sheet with said first roller;

a means to rotate said first roller and said second roller in a first direction thereby conveying said sheet along a first conveyance path from an inlet section until a trailing edge portion of said sheet reaches a predetermined distance from said first roller;

a means to rotate said first roller and said second roller in a second direction opposite to said first direction thereby conveying said sheet along a second conveyance path to an outlet section, said second conveyance path being in substantially the same direction as said first conveyance path, said second roller moving along a circumference of said first roller by a predetermined angle when said first roller and said second roller rotate in said second direction; and a guide means for moving on the circumference of said first roller together with said second roller, said guide means for guiding the sheet along said second conveyance path.

* * * * *